US010874232B2

(12) United States Patent
Honig

(10) Patent No.: US 10,874,232 B2
(45) Date of Patent: Dec. 29, 2020

(54) TUMBLER WITH LED LOGO LIGHT UP

(71) Applicant: Broder Bros., Co., Trevose, PA (US)

(72) Inventor: Michael Honig, Westport, CT (US)

(73) Assignee: BRODER BROS., CO., Trevose, PA (US)

( * ) Notice: Subject to any disclaimer, the term of this patent is extended or adjusted under 35 U.S.C. 154(b) by 0 days.

(21) Appl. No.: 16/246,444

(22) Filed: Jan. 11, 2019

(65) Prior Publication Data

US 2019/0216243 A1 Jul. 18, 2019

Related U.S. Application Data

(66) Substitute for application No. 62/616,591, filed on Jan. 12, 2018.

(51) Int. Cl.

| | |
|---|---|
| ***A47G 19/22*** | (2006.01) |
| ***F21V 7/00*** | (2006.01) |
| ***F21V 23/04*** | (2006.01) |
| ***F21V 33/00*** | (2006.01) |
| *F21Y 113/13* | (2016.01) |
| *F21Y 115/10* | (2016.01) |

(52) U.S. Cl.

CPC ..... *A47G 19/2227* (2013.01); *A47G 19/2272* (2013.01); *F21V 7/00* (2013.01); *F21V 23/0442* (2013.01); *F21V 23/0471* (2013.01); *F21V 23/0485* (2013.01); *F21V 33/0036* (2013.01); *A47G 2019/2238* (2013.01); *A47G 2200/146* (2013.01); *F21Y 2113/13* (2016.08); *F21Y 2115/10* (2016.08)

(58) Field of Classification Search

CPC ..... A47G 2019/2238

See application file for complete search history.

(56) References Cited

U.S. PATENT DOCUMENTS

| | | | | |
|---|---|---|---|---|
| 6,591,524 B1 * | 7/2003 | Lewis | ..... | A47G 19/2227 310/339 |
| 6,923,549 B2 * | 8/2005 | Hoy | ..... | A47G 19/2227 362/101 |
| 9,452,876 B2 * | 9/2016 | Anelevitz | ..... | A47G 19/2227 |

(Continued)

FOREIGN PATENT DOCUMENTS

WO WO-2008128346 A1 * 10/2008 ..... A47J 41/0061

OTHER PUBLICATIONS

Arduino Forum, Arduino sound sensor to control brightness of LED?, Jan. 1, 2015, Arduino (Year: 2015).*

*Primary Examiner* — Evan P Dzierzynski
*Assistant Examiner* — Keith G. Delahoussaye
(74) *Attorney, Agent, or Firm* — Myers Wolin, LLC

(57) ABSTRACT

A tumbler including: an outer shell; an inner shell nested with the outer shell; a base; and a light source assembly; wherein: an outer surface of inner shell includes a reflective material; the outer shell includes one or more areas that are transparent or translucent; the bottom of the outer shell connects to the base, the top of the outer shell connects to the top of the inner shell, and the inner shell tapers more than the outer shell for at least a part along the length from the top to the bottom, creating a space between the inner shell and outer shell; the light source assembly emits lights into the space and the light is reflected by the reflective material to go out of the outer shell from the one or more areas that are transparent or translucent.

11 Claims, 10 Drawing Sheets

(56) References Cited

U.S. PATENT DOCUMENTS

| | | | | |
|---|---|---|---|---|
| 10,401,019 | B2 * | 9/2019 | Xia | F21V 23/0485 |
| 2005/0207141 | A1 * | 9/2005 | Boesch | A47G 19/2227<br>362/101 |
| 2007/0210095 | A1 * | 9/2007 | Bigger | A47G 23/0216<br>220/741 |
| 2010/0157579 | A1 * | 6/2010 | Kononuk | A47G 23/0309<br>362/101 |
| 2012/0261379 | A1 * | 10/2012 | Lenahan | B65D 23/102<br>215/228 |
| 2013/0271963 | A1 * | 10/2013 | Zalon | F21V 33/0036<br>362/101 |
| 2015/0292729 | A1 * | 10/2015 | Sutton | F21V 33/0024<br>362/101 |
| 2018/0360243 | A1 * | 12/2018 | O'Neal | F21V 33/0036 |

* cited by examiner (A) (B)

(A) (B)

(A) (B)

TUMBLER WITH LED LOGO LIGHT UP

CROSS REFERENCE TO RELATED APPLICATIONS

This application claims the benefit of provisional application U.S. 62/616,591 filed on Jan. 12, 2018, the entire contents of which is incorporated herein by reference.

FIELD OF THE INVENTION

One embodiment of this invention relates to a tumbler, mug or bottle with a logo, and more particularly one with a LED to light up the logo.

BACKGROUND

Many tumblers, mugs, or bottles have decorative figures or patterns on their sidewall. Some decorative figures or patterns include logos, signs, or trademarks to bring attention to people nearby. However, the environment surrounding the tumblers may make the logos less effective, such as a dark environment, or a location in which many other nearby items are also competing for attention. Therefore, there is a need for making the logo stand out in these environments.

Some embodiments of the present invention provide a solution to the above problem by illuminating the logo on the tumbler, mug or bottle, so that it is easier to get people's attention. Furthermore, the illumination may be turned on or off based on sound level, motion detection, touch or pressure.

SUMMARY

One embodiment of the present invention provides a tumbler including: an outer shell; an inner shell nested with the outer shell; a base; and a light source assembly; wherein: an outer surface of inner shell includes a reflective material; the outer shell includes one or more areas that are transparent or translucent; the bottom of the outer shell connects to the base, the top of the outer shell connects to the top of the inner shell, and the inner shell tapers more than the outer shell for at least a part along the length from the top to the bottom, creating a space between the inner shell and outer shell; the light source assembly emits light into the space and the light is reflected by the reflective material to go out of the outer shell from the one or more areas that are transparent or translucent.

One embodiment of the present invention provides a tumbler including: an outer shell; an inner shell nested with the outer shell; a base; and a light source assembly; wherein: the outer shell includes a window; the inner shell is made of a transparent or translucent material and is selectively covered with an opaque material such that one or more areas of the inner shell remain transparent or translucent and are visible within the window of the outer shell; the inner shell further includes an uncovered area for receiving light from the light source assembly, and the light travels through the transparent or translucent material to go out of the inner shell from the one or more areas that remain transparent or translucent.

One embodiment of the present invention provides a bottle including: an outer shell; an inner shell nested with the outer shell; a base; and a light source assembly; wherein: an outer surface of inner shell comprises a reflective material; the outer shell comprises one or more areas that are transparent or translucent; the outer shell and the inner shell are of a bottle shape having a neck, a body and a mouth; the bottom of body of the outer shell is open and connects to the base, the mouth of the outer shell connects to the mouth of the inner shell, and a diameter of the body of the inner shell is smaller than a diameter of the body of the outer shell, creating a space between the inner shell and outer shell; the light source assembly emits light into the space and the light is reflected by the reflective material to go out of the outer shell from the one or more areas that are transparent or translucent.

DETAILED DESCRIPTION OF THE PREFERRED EMBODIMENTS

Figure 1:
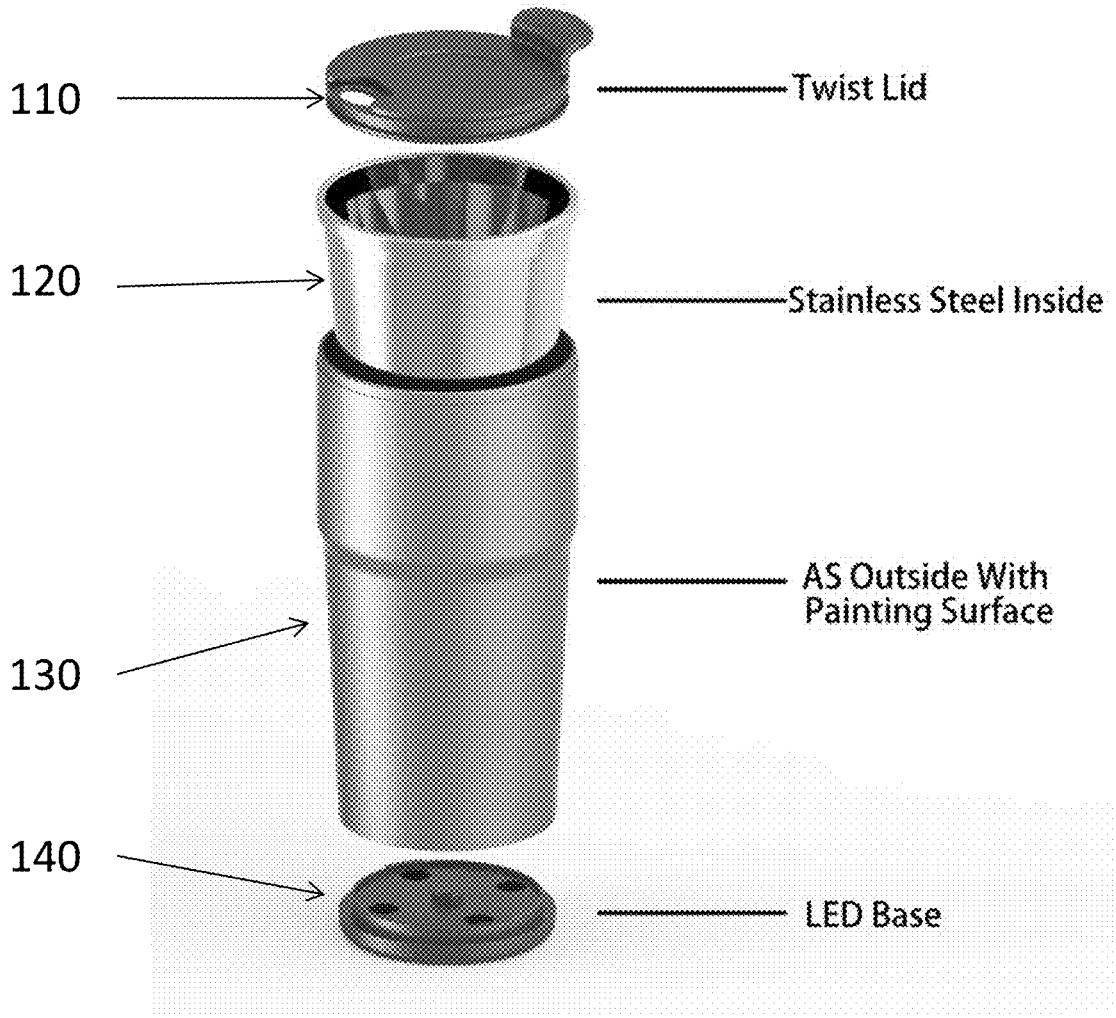
FIG. 1 is an exploded perspective view of a tumbler according to an embodiment of the invention.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

This disclosure describes the best mode or modes of practicing the invention as presently contemplated. This description is not intended to be understood in a limiting sense, but provides an example of the invention presented solely for illustrative purposes by reference to the accompanying drawings to advise one of ordinary skill in the art of the advantages and construction of the invention. In the various views of the drawings, like reference characters designate like or similar parts.

FIG. 1 is an exploded perspective view of a tumbler according to an embodiment. The tumbler includes a lid 110, which may be a twist-on or snap-on type. An inner shell 120 is nested with an outer shell 130. The outer shell 130 joins with a base 140. In one embodiment, the inner shell is made of stainless steel or other reflective materials, so that light from the LED base 140 is reflected by the surface of the inner shell. In one embodiment, the outer shell is made of a transparent or translucent material. To make a logo or a pattern on the surface of the outer shell, in one embodiment, the surface of the outer shell is covered by paint or an opaque material, and then the logo or pattern is revealed by etching, engraving or other paint removal techniques. In another embodiment, the surface of the outer shell is covered with a stencil bearing the logo or design pattern, and then the outer shell is painted and then the logo or pattern is revealed by removing the stencil.

Figure 2:
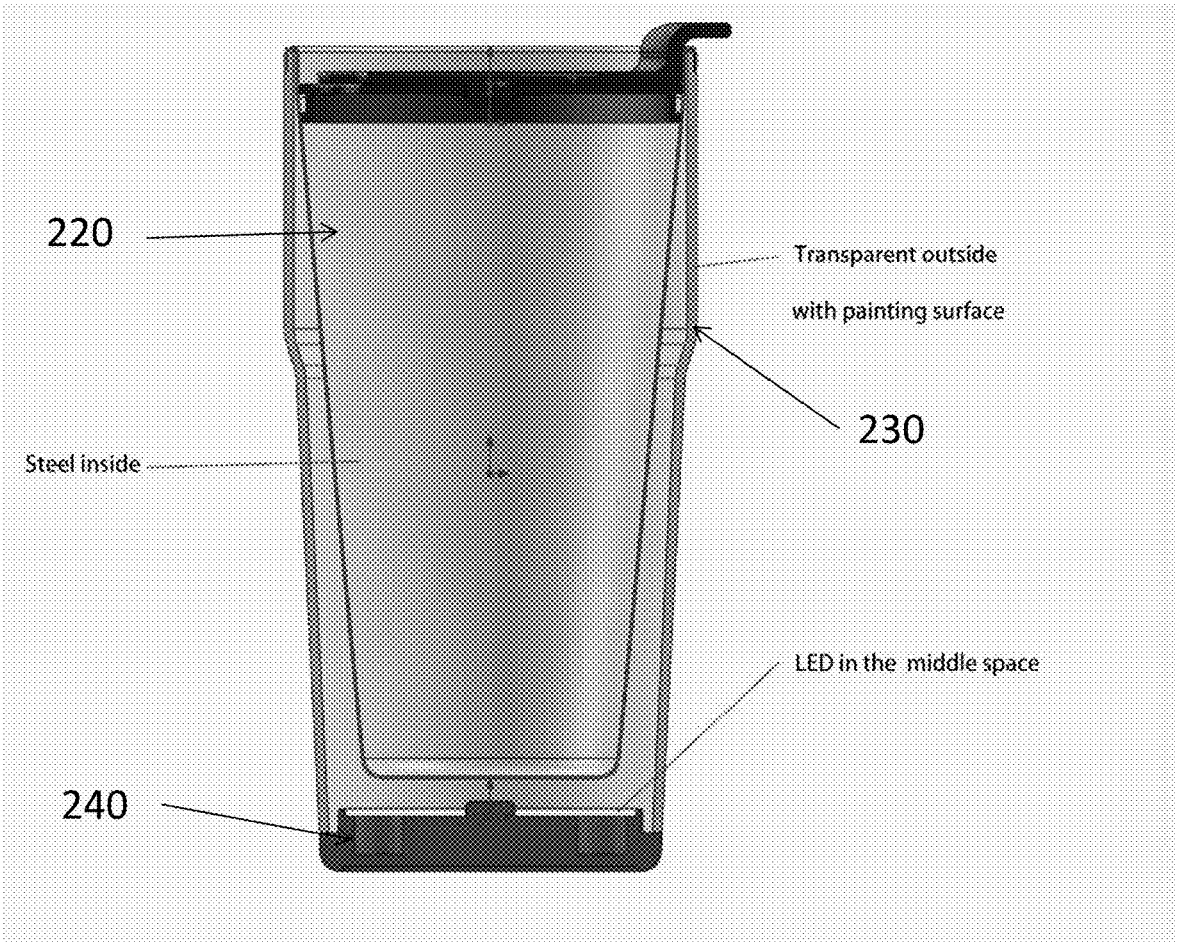
FIG. 2 is a cross-sectional view of a tumbler according to an embodiment of the invention.

FIG. 2 shows the cross-sectional view of a tumbler according to an embodiment. The inner shell 220 fits snuggly with the outer shell 230 at the top near the rim of the tumbler. The diameter of the inner shell 220 decreases or tapers in the downward direction towards the based. The diameter of the outer shell 230 may or may not decrease or taper, such that at least at some point below the rim of the tumbler, the diameter of the outer shell is generally larger than the diameter of the inner shell. In this way, a space is created between the outside wall of the inner shell 220 and the inside wall of the outer shell 230. This space allows light travel up from a light source assembly by reflections on the surface of the inner shell, which is made of a reflective material, such as stainless steel, aluminum, etc. The reflected light eventually reaches the transparent or translucent areas on the outer shell and lights up the logo or design pattern. In one embodiment, the inner shell 220 is shorter than the outer shell 230 such that the bottom of the inner shell does not touch the base 240.

Figure 3:
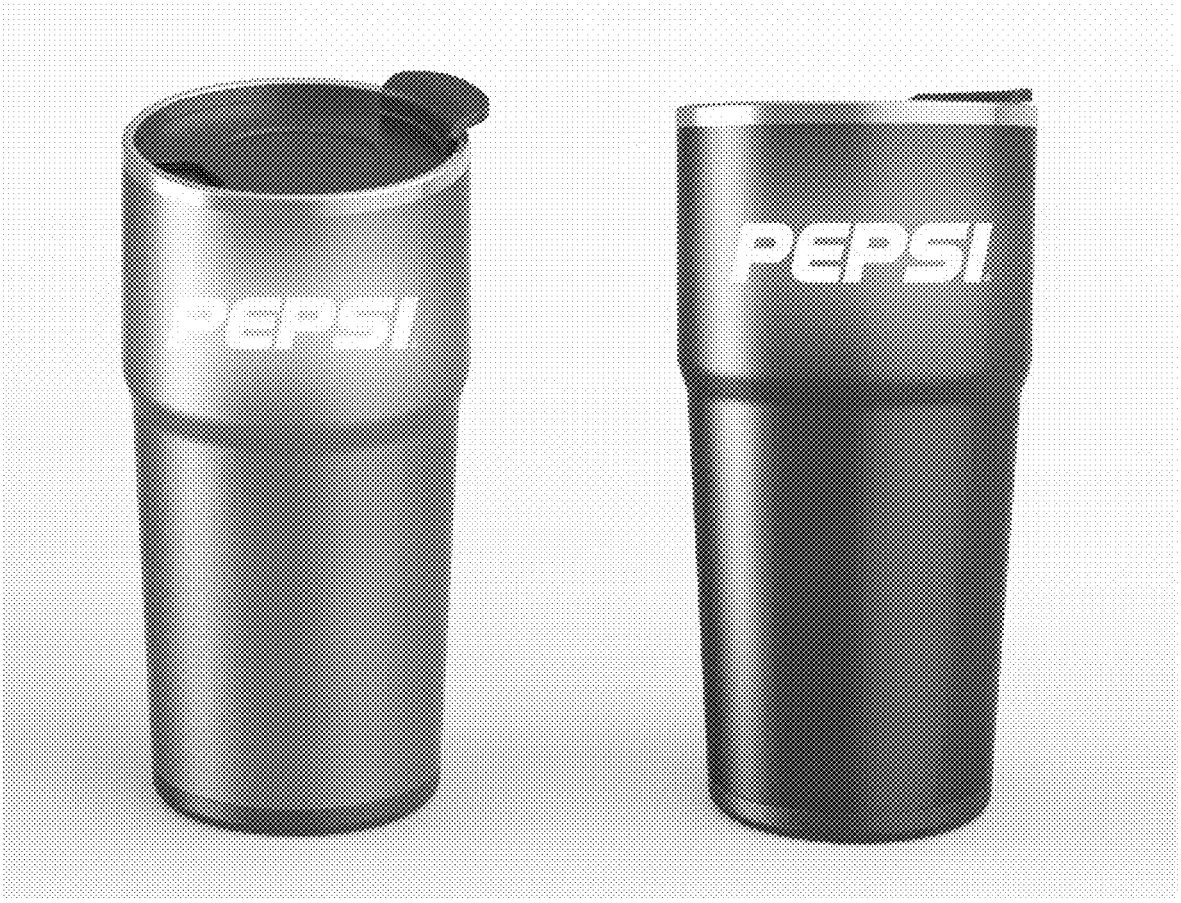
FIG. 3 is a perspective view and a front view of a tumbler according to an embodiment of the invention.

FIG. 3 shows two views of a logo on a tumbler being lit up according to an embodiment.

In one embodiment, the light source assembly is integrated into the base. In another embodiments, the light source assembly may be placed at a desired location inside the space created between the outside wall of the inner shell and the inside wall of the outer shell.

Figure 6:
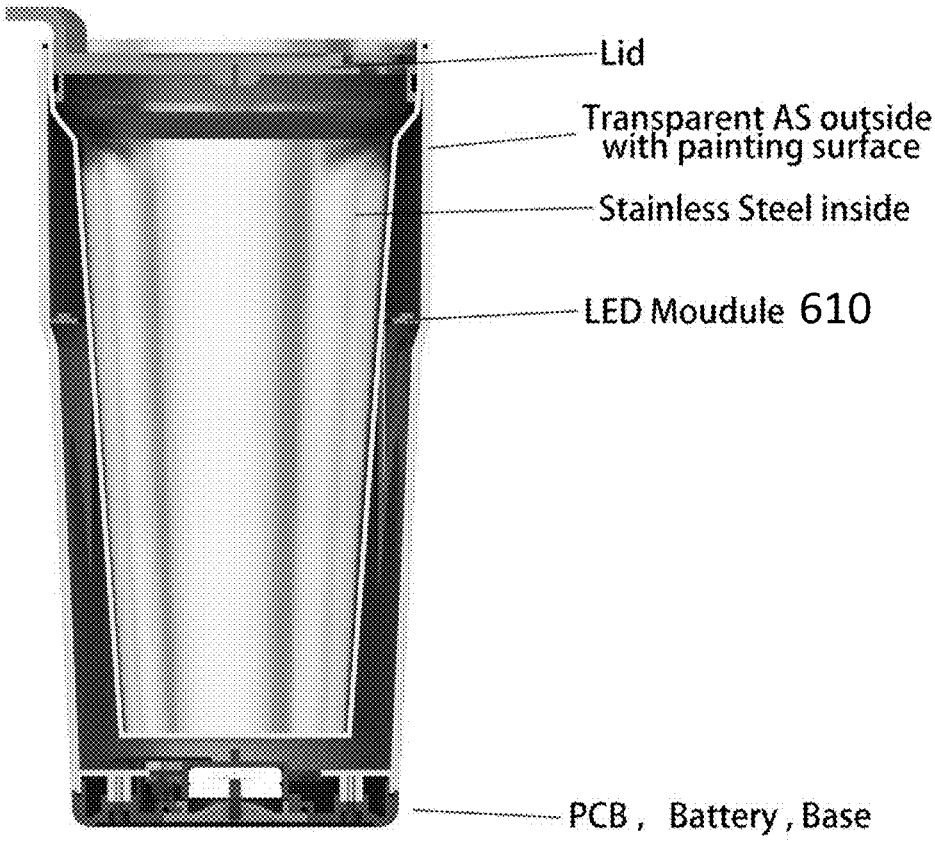
FIG. 6 is a cross-sectional view of a tumbler according to an embodiment of the invention.
Figure 7:
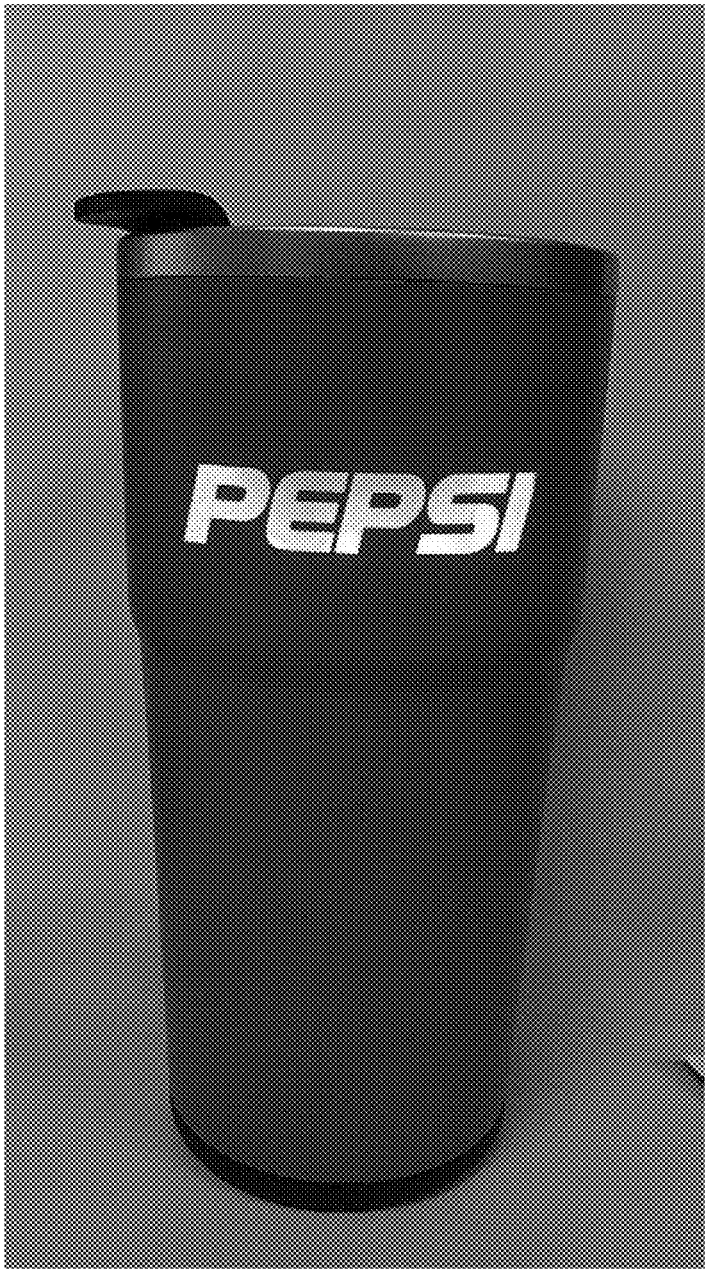
FIG. 7 shows the light effect of a tumbler according to an embodiment of the invention.

FIG. 6 shows an embodiment in which a LED module 610 is placed adjacent to the transparent or translucent areas. The LED module may include multiple LEDs of same or different colors. This way, the lit transparent or translucent areas exhibit localized variation in color and/or intensities. FIG. 7 shows the light effect on the logo according to an embodiment.

The light source assembly may include LED, light bulb, laser, multi-color light sources, etc. The light source assembly may include power source, such as a replaceable battery or rechargeable battery. The light source assembly may include circuitry for controlling the light emission, such as turning on and off, changing the light intensities, colors, etc. The light source assembly may include program coded circuitry to produce a sequence of programmed light patterns based on a predetermined condition.

Furthermore, the light source assembly may include sensors and switches. For example, in one embodiment, the light source assembly includes a sound level detector to measure the ambient sound level. This is particularly useful in a party where loud music is play. The circuitry may be configured to turn on the light when the sound level reaches certain decibel, e.g., >100 dB, so the logo or design pattern may flash according to the beat of the music. Furthermore, the light intensity or color may also be varied with the sound level.

In one embodiment, the light source assembly includes a motion sensor, so that the logo lights up when the tumbler is being moved, and the light is off when the tumbler is stationary. Furthermore, the motion sensor may be configured to detect the motion of an object in the vicinity, so that when a person approaches the tumbler, the logo lights up. In another embodiment, the light source assembly includes a touch sensor, so that the logo lights up when the tumbler is touched. In another embodiment, the light source assembly includes a pressure switch mounted at the bottom of the base, so that the logo lights up when the tumbler is lifted up and the light is off when the tumbler is put down. The light source assembly may include a master switch to turn off power to preserved battery when the tumbler is not in use.

Figure 4:
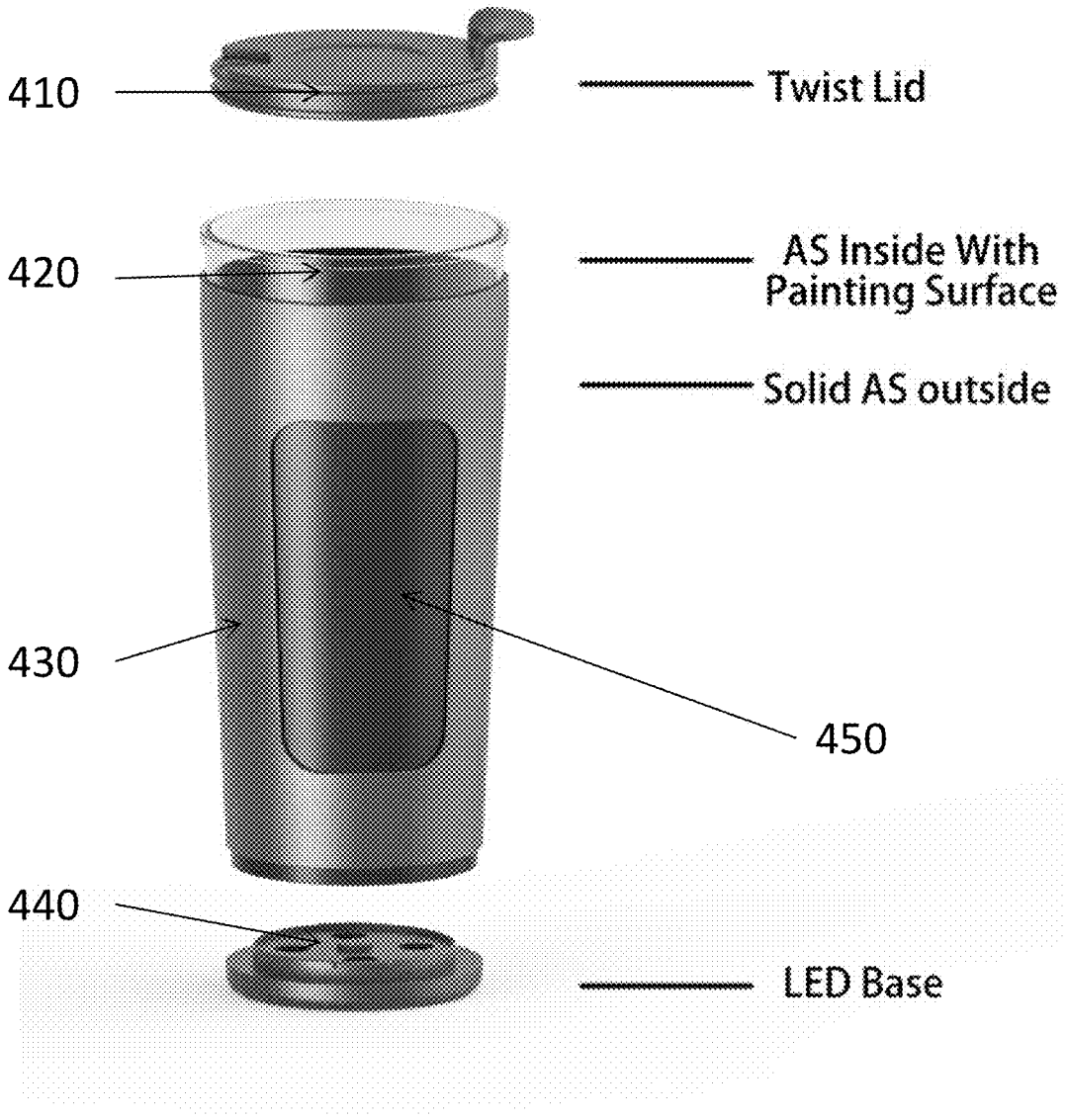
FIG. 4 is an exploded perspective view of a tumbler according to an embodiment of the invention.

FIG. 4 illustrates a tumbler according to another embodiment. In this embodiment, the tumbler includes a lid 410, which may be a twist-on or snap-on type. An inner shell 420 is nested with an outer shell 430. The outer shell 430 joins with a base 440. The logo or design pattern is on the surface of the inner shell 420. The outer shell 430 has a window 450 so that the logo or design pattern may be visible through the window. In one embodiment, the inner shell is a made of a transparent or translucent material, such as acrylonitrile styrene (AS) plastic, glass, etc. Like the above, to make a logo or a pattern on the surface of the inner shell, the surface of the inner shell is covered by paint or an opaque material, and then the logo or pattern is revealed by etching, engraving or other paint removal techniques. Alternatively, the surface of the inner shell is covered with a stencil bearing the logo or design pattern, and then the inner shell is painted and then the logo or pattern is revealed by removing the stencil. The inner shell includes one or more uncovered areas to receive light from the light source. For example, if the light source is at the base, the bottom of the inner shell is unpainted or uncovered. Light enters the transparent or translucent material through the one or more uncovered areas. The transparent or translucent material of the inner shell acts as a light wave guide to allow the light travels to the logo or design pattern areas. Because the logo or design pattern areas are not painted or covered, light can get out from the logo or design pattern areas, and the lit up logo can been seen from the window of the outer shell.

Figure 5:
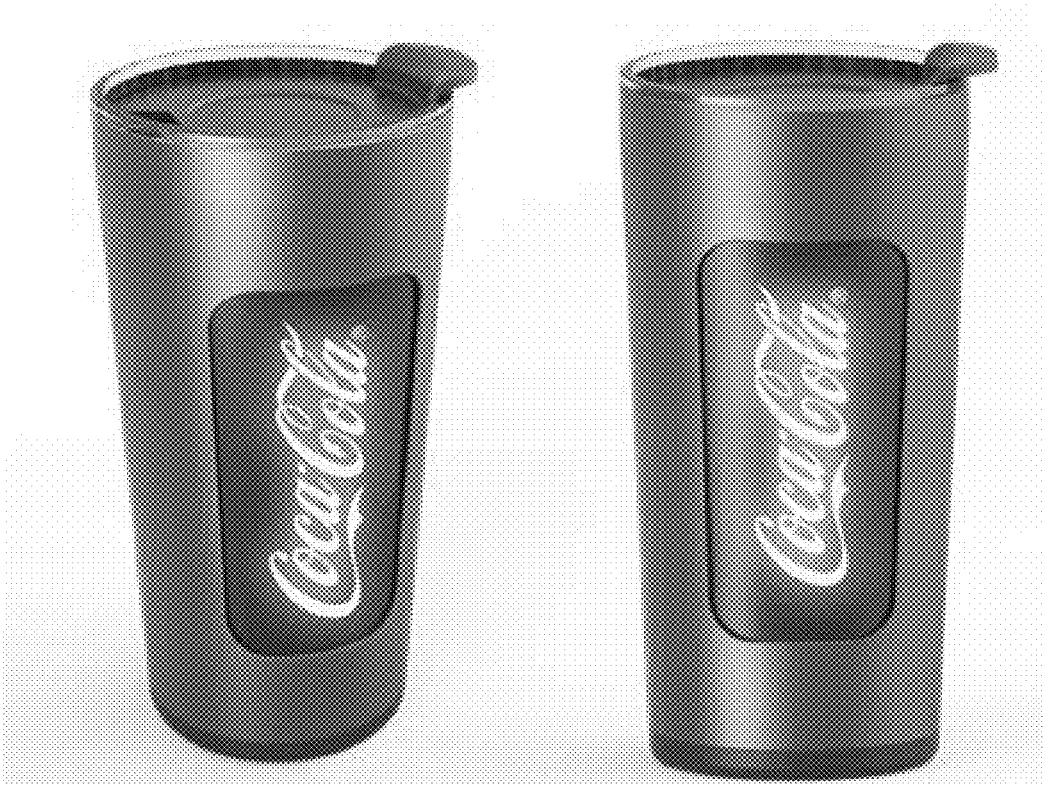
FIG. 5 shows two perspective views of a tumbler according to an embodiment of the invention.

FIG. 5 shows two views of a logo on a tumbler being lit up according to an embodiment.

Figure 8:
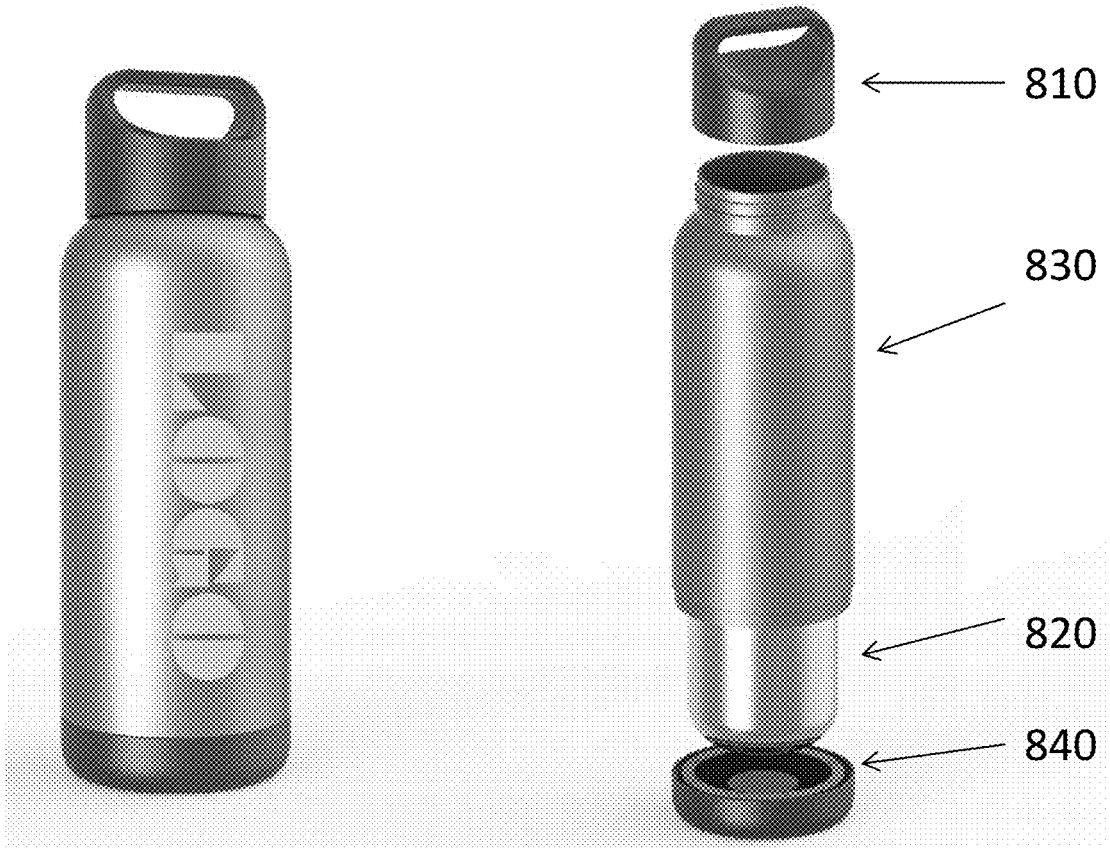
FIG. 8 is a perspective view and an exploded perspective view of a bottle according to an embodiment of the invention.

FIG. 8(A) is a perspective view of a bottle according to an embodiment. As shown in the exploded view in FIG. 8(B), the bottle includes a lid 810, which may be a twist-on or snap-on type. The lid 810 may include a loop, ring, handle, etc. for easy attachment or holding. An inner shell 820 is nested with an outer shell 830. The outer shell 830 joins with a base 840. In one embodiment, the inner shell is made of stainless steel or other reflective materials, so that light from the LED base 840 is reflected by the surface of the inner shell. Similar to the above embodiments, the outer shell is made of a transparent or translucent material. To make a logo or a pattern on the surface of the outer shell, in one embodiment, the surface of the outer shell is covered by paint or an opaque material, and then the logo or pattern is revealed by etching, engraving or other paint removal techniques. In another embodiment, the surface of the outer shell is covered with a stencil bearing the logo or design pattern, and then the outer shell is painted and then the logo or pattern is revealed by removing the stencil.

Figure 9:
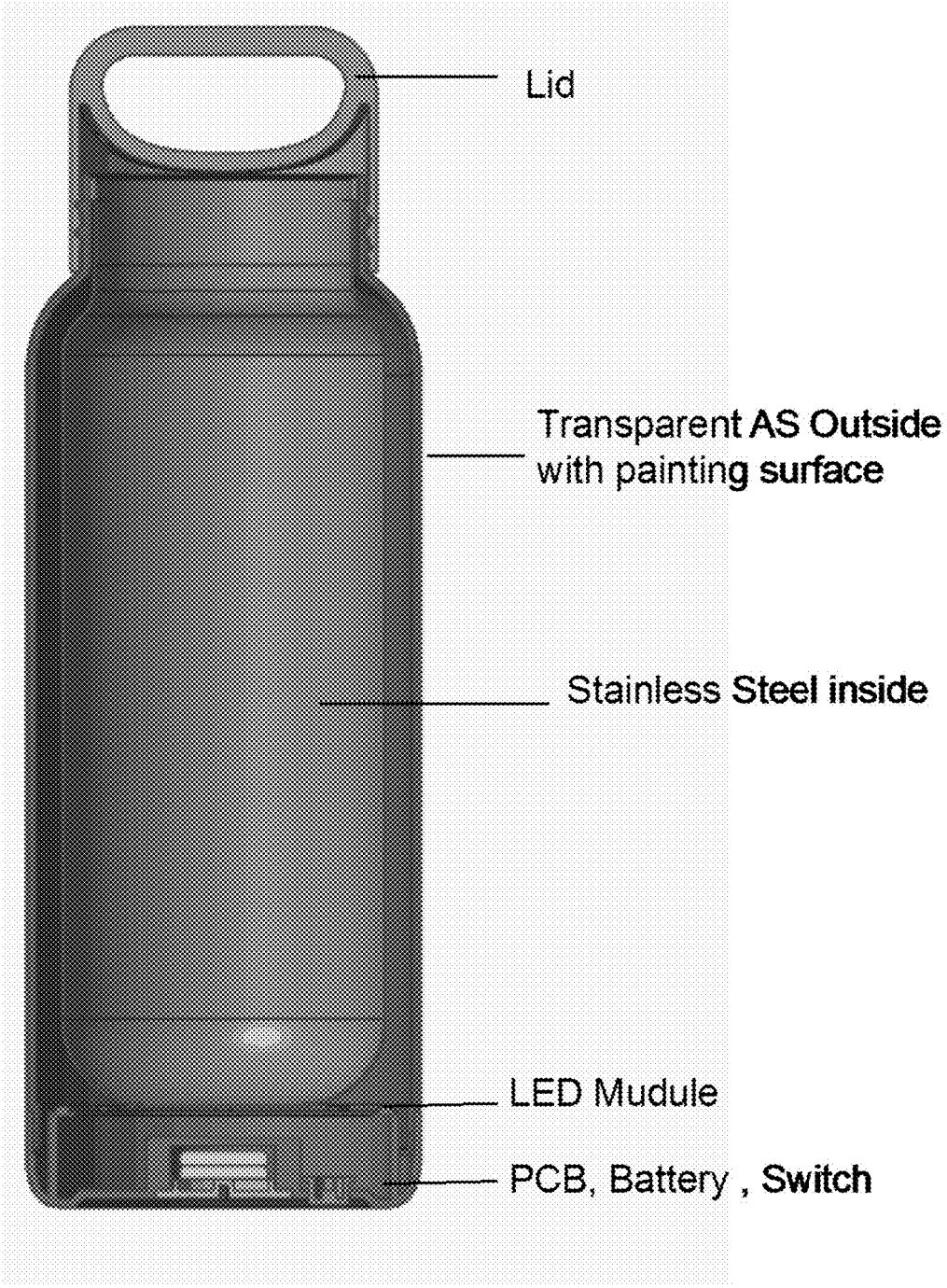
FIG. 9 is a cross-sectional view of a bottle according to an embodiment of the invention.

FIG. 9 shows the cross-sectional view of a bottle according to an embodiment. Note that both the inner shell and outer shell are in the shape of a bottle. That is, each the inner shell and outer shell has a neck, a body and a mouth. FIG. 9 shows that the bottom of the body of the outer shell is open and it connects to the base. The base may include a PCB, battery, switch and LED module. The neck of the inner shell fits snugly in the neck of the outer shell. The mouth of the outer shell connects to the mouth of the inner shell, and a diameter of the body of the inner shell is smaller than a diameter of the body of the outer shell, creating a space between the inner shell and outer shell. Although FIG. 9 shows both the inner shell and the outer shell have a straight body, as long as the body of the inner shell is in general smaller than the body of the outer shell, a space would be created between the shell, regardless of the shape their body. Thus, the light source assembly emits light into the space and the light is reflected by the reflective material to go out of the outer shell from the one or more areas that are transparent or translucent.

Figure 10:
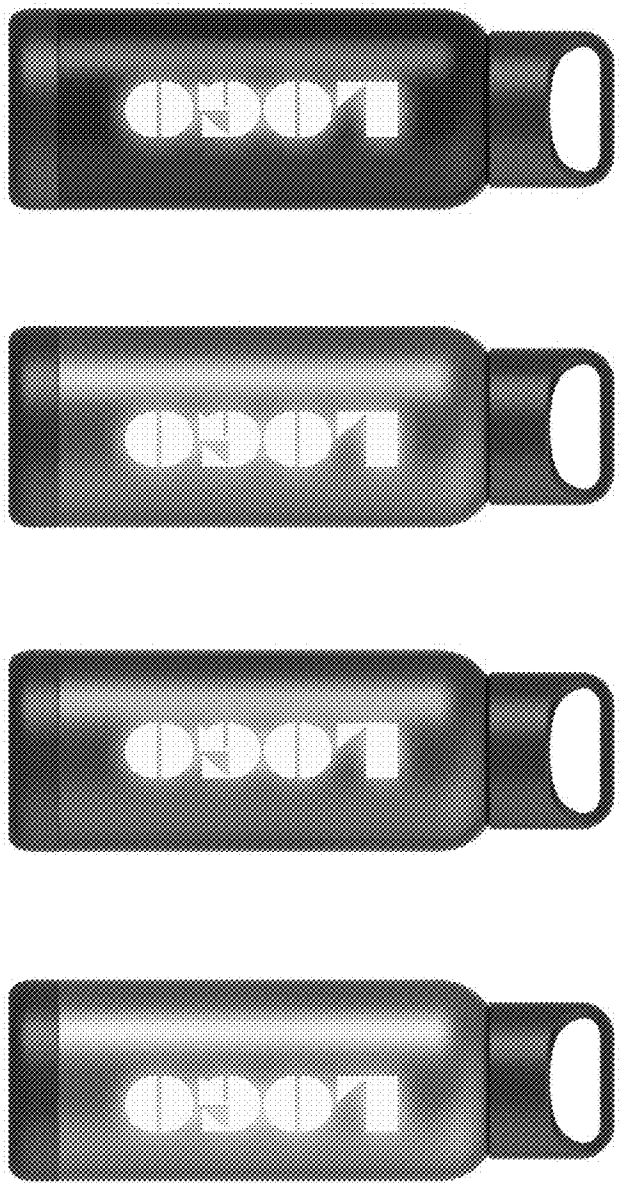
FIG. 10 shows the front view of different color bottles according to an embodiment of the invention.

In one embodiment, the surface of the outer shell of the bottles or tumblers may be painted with different colors. FIG. 10 shows four bottles having different colors with the same logo light up.

While the present invention has been described at some length and with some particularity with respect to the several described embodiments, it is not intended that it should be limited to any such particulars or embodiments or any particular embodiment, but it is to be construed so as to provide the broadest possible interpretation in view of the prior art and, therefore, to effectively encompass the intended scope of the invention. Furthermore, the foregoing describes the invention in terms of embodiments foreseen by the inventor for which an enabling description was available, notwithstanding that insubstantial modifications of the invention, not presently foreseen, may nonetheless represent equivalents thereto.

The functions of the various elements shown in the figures can be provided through the use of dedicated hardware as well as hardware capable of executing software in association with appropriate software. When provided by a processor, the functions can be provided by a single dedicated processor, by a single shared processor, or by a plurality of individual processors, some of which can be shared. Moreover, explicit use of the term "processor" or "controller" should not be construed to refer exclusively to hardware capable of executing software, and can implicitly include, without limitation, digital signal processor ("DSP") hardware, read-only memory ("ROM") for storing software, random access memory ("RAM"), and non-volatile storage. Moreover, all statements herein reciting principles, aspects, and embodiments of the invention, as well as specific examples thereof, are intended to encompass both structural and functional equivalents thereof. Additionally, it is intended that such equivalents include both currently known equivalents as well as equivalents developed in the future (i.e., any elements developed that perform the same function, regardless of structure).

The embodiments of the invention disclosed herein may comprise a system, a method, and/or a computer program product. The computer program product may include a computer readable storage medium (or media) having computer readable program instructions thereon for causing a processor to carry out aspects of the present invention. The computer readable storage medium can be a tangible device that can retain and store instructions for use by an instruction execution device.

The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device may receive computer readable program instructions from the network and forward the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++, Java, Perl, Python or the like, and conventional procedural programming languages, such as the "C" programming language or similar programming languages. The computer readable program instructions may execute entirely on a user's computer, partly on the user's computer, as a standalone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

A processor or processor circuitry may include a device that has any combination of hardware, circuitry, and software. The hardware and circuitry examples may comprise a parallel processor, a processor array, a vector processor, a scalar processor, a multi-processor, a microprocessor, a communication processor, a network processor, a logic circuit, a queue management device, a central processing unit (CPU), a microprocessing unit (MPU), system on a chip (SoC), a digital signal processor (DSP), an integrated circuit (IC), an application specific integrated circuit (ASIC), a programmable logic device (PLD), and a field programmable gate array (FPGA). A processor or processor circuitry may include one or more processors, one or more circuits and/or software, that responds to and processes basic computer instructions and carries out the instructions of a computer program by performing the basic arithmetic, logical, control and input/output (I/O) operations specified by the instructions, one or more of: an arithmetic logic unit (ALU), which may carry out arithmetic and logic operations on the operands in instructions; a floating point unit (FPU), also known as a math coprocessor or numeric coprocessor, which is a specialized coprocessor that may manipulate numbers more quickly than the basic microprocessor circuitry can in some cases; one or more registers, which may hold instructions and other data and supply operands to the ALU and store the results of operations; and cache memory, which may save time compared to having to get data from random access memory (RAM). A processor or processor circuitry may also include one or more circuits comprising electronic components, such as resistors, memristors, power sources, magnetic devices, motors, generators, solenoids, microphones, speakers, transistors, capacitors, inductors, diodes, semiconductors, switches, antennas, transducers, sensors, detectors, vacuums, tubes, amplifiers, radio receivers, crystals, and oscillators connected by conductive wires or traces through which electric current can flow. The combination of components and wires may allow various simple and complex operations to be performed: signals may be amplified, computations can be performed, and data can be moved from one place to another.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to explain the principles of the embodiments, the practical application or technical improvement over technologies found in the marketplace, or to enable others of ordinary skill in the art to understand the embodiments disclosed herein.

The invention claimed is:

1. A tumbler comprising:

an outer shell;

an inner shell nested with the outer shell;

a base; and a light source assembly;

wherein:

an outer surface of inner shell comprises a reflective material;

the outer shell comprises one or more areas that are transparent or translucent;

the bottom of the outer shell connects to the base, the top of the outer shell connects to the top of the inner shell, and the inner shell tapers more than the outer shell for at least a part along the length from the top to the bottom, creating a space between the inner shell and outer shell; and the light source assembly emits light into the space and the light is reflected by the reflective material to go out of the outer shell from the one or more areas that are transparent or translucent.

2. The tumbler of claim 1, wherein the light source assembly is integrated into the base.

3. The tumbler of claim 1, wherein the light source assembly comprises a sound level detector such that the light is turned on or off based on a sound level detected.

4. The tumbler of claim 1, wherein the light source assembly comprises a motion detector such that the light is turned on or off based on whether motion is detected.

5. The tumbler of claim 1, wherein the light source assembly comprises a pressure sensor configured that the light is turned on or off based on whether the tumbler is put on a surface.

6. The tumbler of claim 1, wherein the light source assembly comprises a switch that turns the light on or off.

7. The tumbler of claim 1, wherein the light source assembly comprises light sources of different colors.

8. The tumbler of claim 1, wherein the light source assembly comprises a sound level detector such that an intensity of the light emitted is based on a sound level detected.

9. The tumbler of claim 1, wherein the light source assembly comprises a touch sensor on such that the light is turned on or off based on whether the tumbler is touched.

10. The tumbler of claim 1, wherein the light source assembly comprises a light source placed adjacent to the one or more areas that are transparent or translucent.

11. A bottle comprising:

an outer shell;

an inner shell nested with the outer shell;

a base; and a light source assembly;

wherein:

an outer surface of inner shell comprises a reflective material;

the outer shell comprises one or more areas that are transparent or translucent;

the outer shell and the inner shell are of a bottle shape having a neck, a body and a mouth;

the bottom of body of the outer shell is open and connects to the base, the mouth of the outer shell connects to the mouth of the inner shell, and a diameter of the body of the inner shell is smaller than a diameter of the body of the outer shell, creating a space between the inner shell and outer shell; and the light source assembly emits light into the space and the light is reflected by the reflective material to go out of the outer shell from the one or more areas that are transparent or translucent.

* * * * *